US010681955B2

(12) United States Patent
Beers et al.

(10) Patent No.: US 10,681,955 B2
(45) Date of Patent: Jun. 16, 2020

(54) INTERCHANGEABLE SOLE SYSTEM

(75) Inventors: Sean Beers, Portland, OR (US); Matt Martin, Portland, OR (US); Carl Blakeslee, Portland, OR (US)

(73) Assignee: OT Intellectual Property, LLC, Portland, OR (US)

( * ) Notice: Subject to any disclaimer, the term of this patent is extended or adjusted under 35 U.S.C. 154(b) by 508 days.

(21) Appl. No.: 13/412,471

(22) Filed: Mar. 5, 2012

(65) Prior Publication Data

US 2012/0227289 A1 Sep. 13, 2012

Related U.S. Application Data

(60) Provisional application No. 61/450,391, filed on Mar. 8, 2011.

(51) Int. Cl.

| | |
|---|---|
| ***A43B 3/24*** | (2006.01) |
| ***A43B 13/36*** | (2006.01) |
| ***A43B 3/12*** | (2006.01) |

(52) U.S. Cl.

CPC ..... *A43B 3/246* (2013.01); *A43B 3/128* (2013.01); *A43B 13/36* (2013.01)

(58) Field of Classification Search

CPC ..... A43B 13/145; A43B 13/63; A43B 13/28; A43B 13/00; A43B 13/12; A43B 13/141; A43B 3/24; A43B 3/242; A43B 3/0047; A43B 3/246

USPC ..... 36/15

See application file for complete search history.

(56) References Cited

U.S. PATENT DOCUMENTS

| | | | | |
|---|---|---|---|---|
| 2,368,314 | A * | 1/1945 | Marx | A43B 3/24 36/101 |
| 2,495,984 | A * | 1/1950 | Roy | A43B 3/24 36/101 |
| 4,317,294 | A * | 3/1982 | Goodyear | A43B 13/36 36/100 |
| 4,377,042 | A * | 3/1983 | Bauer | A43B 13/36 36/101 |
| 5,317,822 | A * | 6/1994 | Johnson | A43B 13/36 36/101 |
| 6,442,869 | B2 | 9/2002 | Coomes | |
| 6,640,373 | B2 * | 11/2003 | Tsai | A43B 3/122 12/142 S |
| 6,813,847 | B2 | 11/2004 | Workman | |
| 7,331,123 | B2 | 2/2008 | Workman | |
| 7,520,069 | B2 | 4/2009 | Workman | |

(Continued)

FOREIGN PATENT DOCUMENTS

| | | |
|---|---|---|
| WO | 86/04489 | 8/1986 |

*Primary Examiner* — Megan E Lynch

(74) *Attorney, Agent, or Firm* — Ganz Pollard, LLC

(57) ABSTRACT

An item of footwear having an interchangeable sole system, midsoles for such an item of footwear, and related methods for making such midsoles, including a receptacle incorporated in the midsole wherein a portion of the receptacle is configured to complement an engageable element of a sole unit so that a bidirectional stop is provided that helps secure the sole unit to the midsole, and wherein a material property of the receptacle differs from a material property of the midsole so that the midsole provides cushioning to the item of footwear, and the receptacle allows for engagement and disengagement of the engageable element of the sole unit to the midsole without the need for an outsole frame.

24 Claims, 16 Drawing Sheets

(56) References Cited

U.S. PATENT DOCUMENTS 7,721,466 B2 * 5/2010 Guo ..... A43B 13/36 36/15
7,874,083 B1 * 1/2011 Tillman ..... A43B 13/26 36/15
7,984,569 B2 7/2011 Chaney
2002/0178613 A1 * 12/2002 Williamson et al. ..... 36/15
2003/0200675 A1 10/2003 Gross
2005/0034332 A1 2/2005 Moschel et al.
2005/0138840 A1 * 6/2005 Feldstein ..... A43B 13/36 36/8.3
2006/0021260 A1 * 2/2006 Kim ..... A43B 5/00 36/130
2006/0042119 A1 * 3/2006 Workman et al. ..... 36/15
2006/0156587 A1 * 7/2006 Pawlus et al. ..... 36/100
2007/0033833 A1 * 2/2007 Chang et al. ..... 36/30 R
2007/0227039 A1 * 10/2007 Chaney ..... A43B 5/08 36/15
2007/0240336 A1 * 10/2007 Richardson ..... A43B 1/0054 36/101
2007/0271816 A1 * 11/2007 Workman et al. ..... 36/15
2007/0277401 A1 * 12/2007 Young-Chul ..... 36/30 R
2008/0047167 A1 * 2/2008 Pawlus et al. ..... 36/101
2008/0072453 A1 * 3/2008 Mizrahi ..... 36/44
2008/0098623 A1 * 5/2008 Komitau ..... A43B 3/244 36/101
2008/0222920 A1 * 9/2008 Rovida ..... 36/100
2008/0235992 A1 * 10/2008 Stefani ..... 36/101
2008/0289222 A1 * 11/2008 Candrian et al. ..... 36/101
2009/0056172 A1 * 3/2009 Cho ..... 36/3 B
2009/0064535 A1 * 3/2009 Spanks et al. ..... 36/19.5
2009/0126230 A1 * 5/2009 McDonald et al. ..... 36/88
2009/0172971 A1 * 7/2009 Peikert et al. ..... 36/88
2009/0320330 A1 * 12/2009 Borel et al. ..... 36/30 R
2010/0000127 A1 * 1/2010 Feller et al. ..... 36/101
2010/0122473 A1 * 5/2010 Santos ..... 36/100
2011/0010964 A1 * 1/2011 Hardy et al. ..... 36/103
2011/0154694 A1 * 6/2011 Yamane et al. ..... 36/30 R
2012/0210606 A1 * 8/2012 Gheorghian et al. ..... 36/103

* cited by examiner

INTERCHANGEABLE SOLE SYSTEM

RELATED APPLICATIONS

This application claims the benefit of and priority to U.S. Provisional Application Ser. No. 61/450,391, filed Mar. 8, 2011, the content of which is hereby incorporated by reference as if recited in full herein for all purposes.

BACKGROUND

This invention relates to an interchangeable sole system for an item of footwear (e.g., shoes, boots, sandals, slippers) including a sole that can be quickly and easily replaced with other soles having different types of traction surfaces. In particular, the system includes a removable sole unit that interacts directly with a midsole of the footwear. The midsole includes receptacles adapted to help secure the sole unit to the midsole. The interchangeable sole system allows customization of an item of footwear with respect to traction, cushioning, support, fit, performance and/or aesthetic appearance.

Shoes having replaceable soles are well known and are used in many different applications. Examples of shoes where it is desired to have multiple different traction surfaces available on a single shoe are described in U.S. Pat. Nos. 6,813,847, 7,331,123, 7,520,069, and 7,984,569, the contents of which are hereby incorporated by reference in their entireties. These shoes typically include a cavity in the sole of the boot and have a sole plate fill this cavity. The cavity is typically formed in an outsole frame that attaches to a midsole. These soles also have complementary pairs of engageable elements, associated with the sole and sole plate, to provide an interference fit that helps secure the sole plate to the sole. These shoes, however, have a distinct outsole frame that guides and holds the sole plate and that is attached to the midsole.

An example of a removable sole member for a sandal is described in U.S. Pat. No. 6,442,869. The removable soles are attached to the underside of the upper sole by fasteners, screws, snaps, etc. Another example of interchangeable sole system is described in US 2003/0200675. This system includes a series of core modules, a top foot attaching member, and a bottom sole member. The top and foot members have mating components to interconnect with the core modules.

Shoes with interchangeable sole systems are typically heavier than a conventional shoe and have a bulky look. Accordingly, there is a need for a lighter and aesthetically pleasing sole system with improved performance in a variety of footwear applications.

SUMMARY

The inventive subject matter overcomes problems in the prior art by providing midsoles for an item of footwear, interchangeable sole systems incorporating such midsoles, and related methods for making such midsoles and sole systems that have one or more of the following features alone or in combinations:

In one possible embodiment, an interchangeable sole system for an item of footwear has a removable sole unit including an engageable element, a midsole, and a receptacle incorporated in the midsole. A portion of the receptacle may be configured to complement the engageable element of the sole unit so that a bidirectional stop is provided that helps secure the sole unit to the midsole. A material property of the receptacle differs from a material property of the midsole so that the midsole provides cushioning to the item of footwear, and the receptacle allows for engagement and disengagement of the engageable element of the sole unit to the midsole without the need for an outsole frame. In the foregoing embodiment, the midsole may include a first material and the receptacle may include a second material, and wherein the second material is less resilient than the first material. In some embodiments, the midsole may include a material having a first durometer and the receptacle includes a material having a second durometer, and wherein the first durometer is less than the second durometer. For example, the first durometer may range between about 55 Asker C and about 65 Asker C. The second durometer may range between about 75 Shore A and about 85 Shore A. In some embodiments, the midsole may include a foamed material, such as EVA or polyurethane, and the receptacle may include an elastomeric material, such as natural or synthetic rubber. In the foregoing embodiment, the receptacle may include a portion that is exposed along a bottom surface of the midsole. In the foregoing embodiment, the receptacle may have a portion defining a recess that complements the engageable element of the sole unit. For example, the portion defining the recess may allow the engageable element from the sole unit to protrude through the receptacle into a portion of the midsole so that the engageable element is held in place and helps secure the sole unit to the midsole. In the foregoing embodiment, the receptacle may include a strip of material disposed along the lateral periphery and along the medial periphery of the midsole, or a spine disposed along a midline of the midsole and one or more fingers extending from the spine to a periphery of the midsole. In some possible embodiments, a first receptacle is located along a medial periphery of the footwear and a second receptacle is located along a lateral periphery of the footwear. In other embodiments, the receptacle may be located in a rearfoot section, a midfoot section, or a forefoot section of the item of footwear. In some embodiments, the midsole may include at least one surface portion with a plurality of rows of teeth running generally perpendicular to the longitudinal axis of the midsole and the surface portion is adapted to engage a set of complementary teeth on the sole unit.

In another possible embodiment, a midsole for an item of footwear provided with an interchangeable sole system may include a receptacle incorporated in the midsole. The receptacle may have a portion exposed along a bottom surface of the midsole. The receptacle may be configured to complement an engageable element associated with a sole unit so that a bidirectional stop is provided that helps secure the sole unit to the midsole. The receptacle may allow engagement and disengagement of the sole unit to the midsole. In the foregoing embodiment, a material property of the receptacle may differ from a material property of the midsole so that the midsole provides cushioning to the footwear and the receptacle allows for engagement and disengagement of the engageable element of the sole unit to the midsole without the need for an outsole frame. In the foregoing embodiment, the midsole may include a material having a first durometer and the receptacle comprises a material having a second durometer, and wherein the first durometer is less than the second durometer.

The inventive subject matter further contemplates methods for making interchangeable footwear systems and midsoles, for example by forming a midsole, and incorporating a receptacle into the midsole, the receptacle may include an engageable portion that is adapted to complement an engageable element of a sole unit for the item of footwear so that engagement of the engageable element to the engageable portion of the receptacle provides a bidirectional stop that helps secure the sole unit to the midsole without the need for an outsole frame. In some embodiments, the receptacle may be incorporated into the midsole by co-molding. In other embodiments, the receptacle may be stock-fitted to the midsole after molding the receptacle area. In yet another embodiment, the receptacle may include an elastomeric material and the receptacle may be incorporated into the midsole by cementing.

These and other embodiments are described in more detail in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show embodiments according to the inventive subject matter, unless noted as showing prior art.

DETAILED DESCRIPTION

Figure 1:
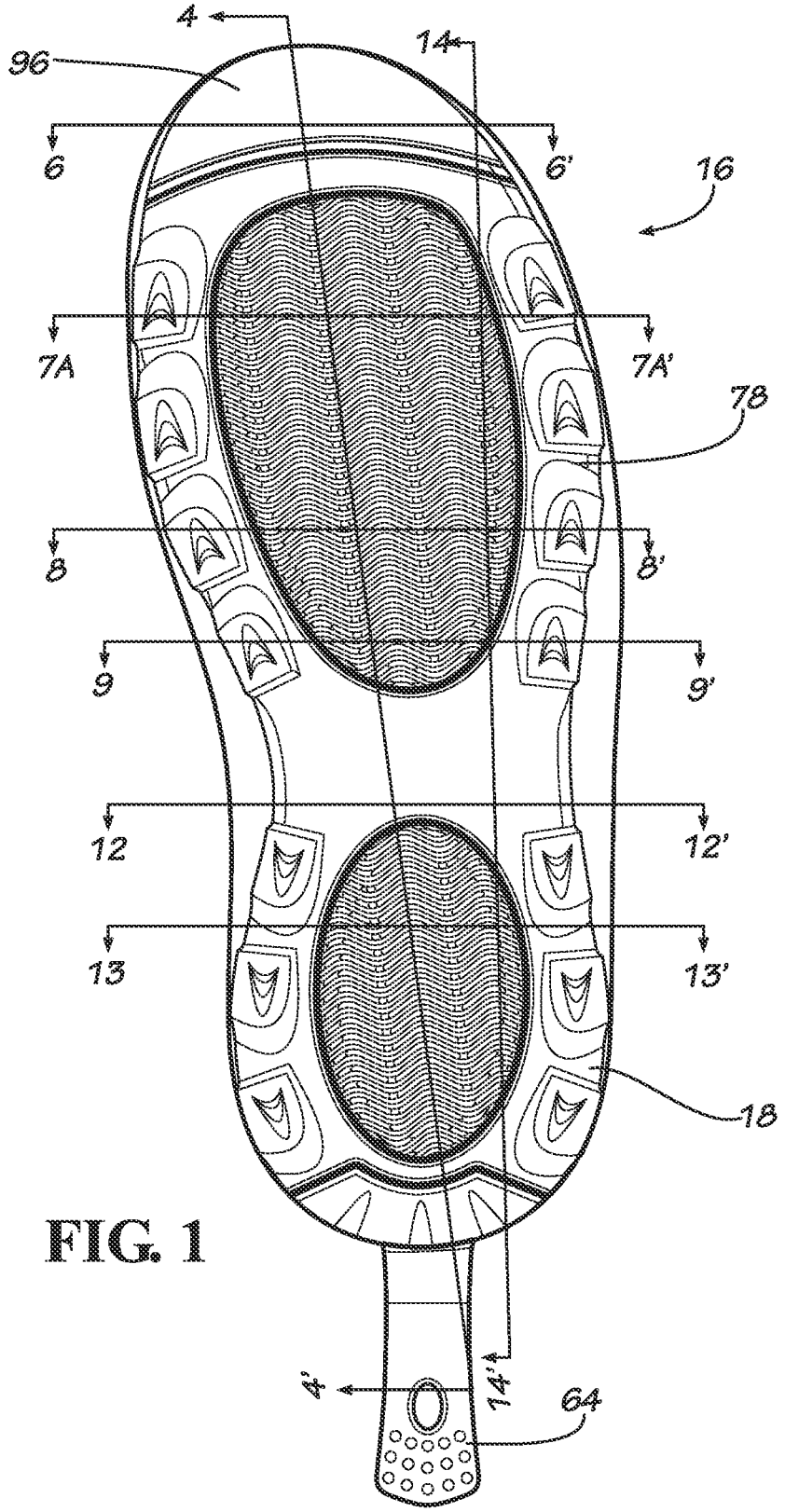
FIG. 1 shows a bottom view of an item of footwear with an interchangeable sole system, including a sole unit and a midsole having receptacles.
Figure 2:
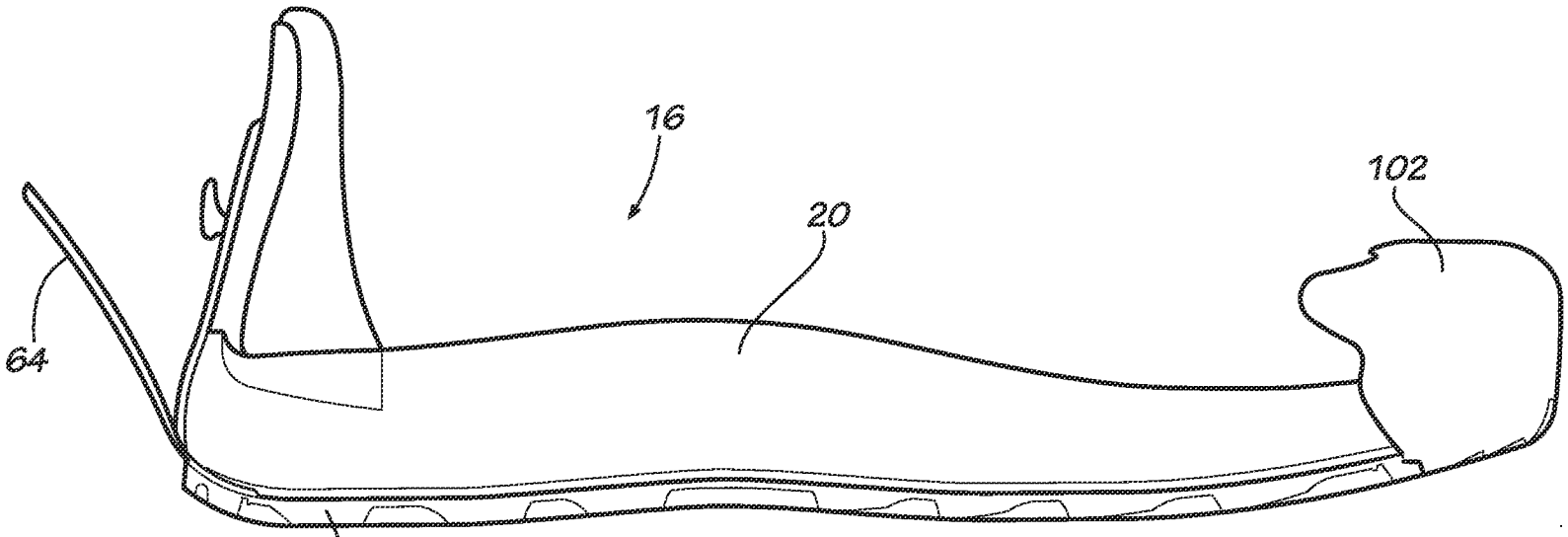
FIG. 2 shows a side view of the interchangeable sole system of FIG. 1 along the medial side of the sole system.
Figure 3:
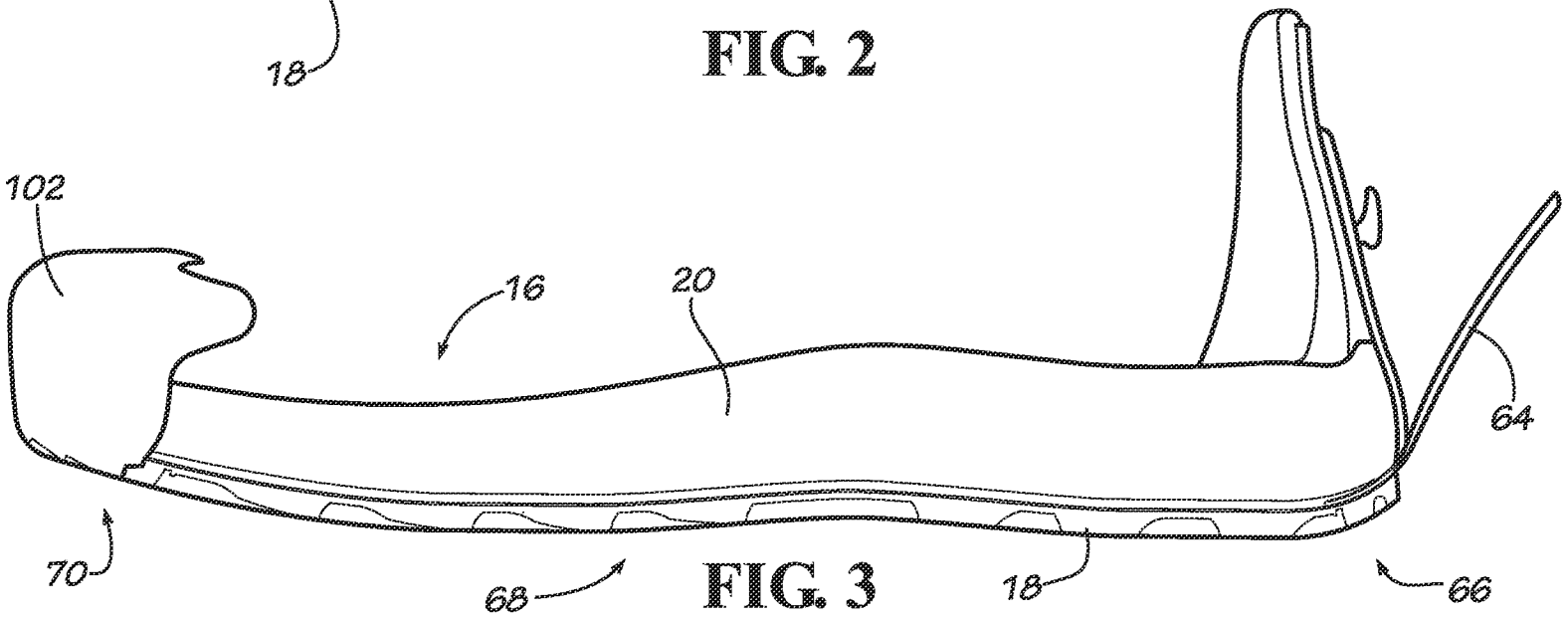
FIG. 3 shows a side view of the interchangeable sole system of FIG. 1 along the lateral side of the sole system.
Figure 4:
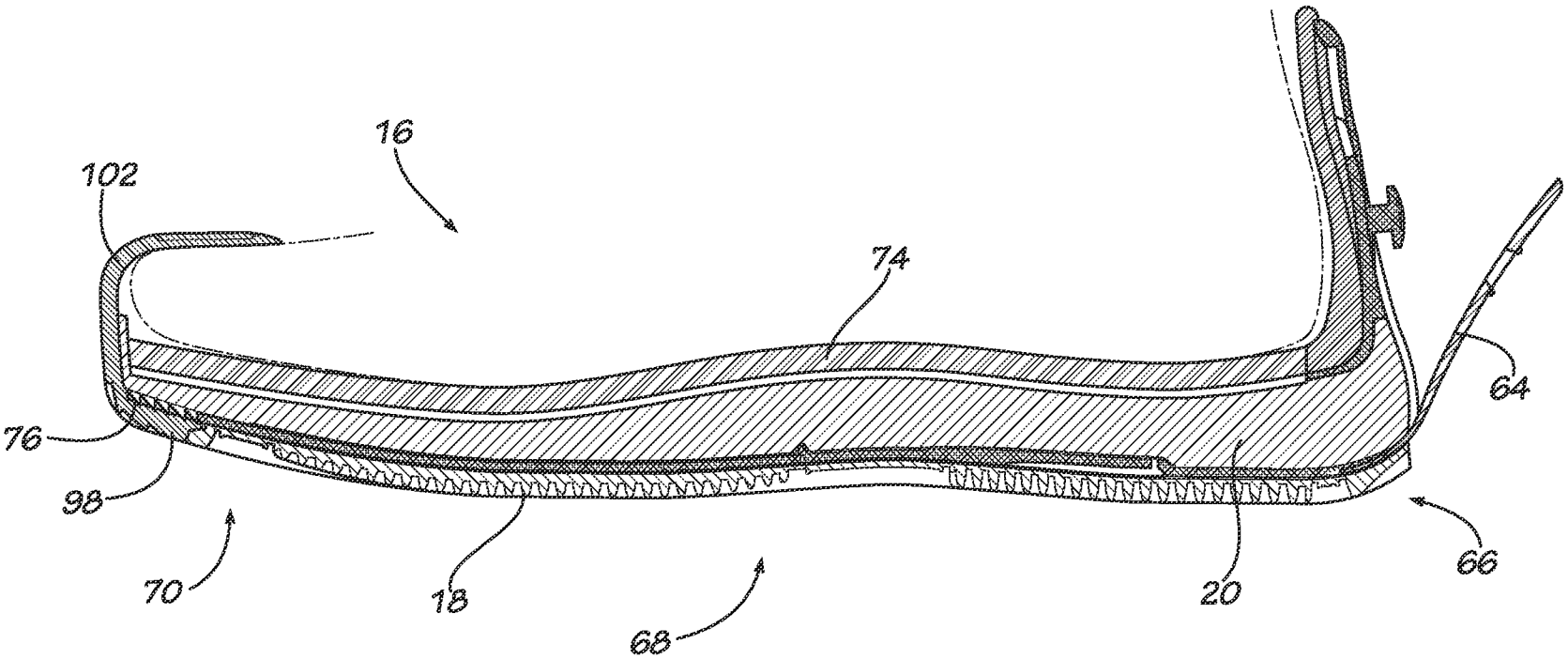
FIG. 4 shows a cross-sectional view along the lines 4-4' in FIG. 1.

Representative embodiments according to the inventive subject matter are shown in FIGS. 1-22, wherein the same or generally similar features share common indications.

The inventive subject matter relates to an interchangeable sole unit for an item of footwear including a removable sole unit that is received directly to a midsole of the item of footwear, without the need for an outsole frame. The combination of a sole unit and midsole provides foot supporting and ground engaging functions, as well as other functionality, that sole systems are known to provide, such as cushioning, support, fit, performance and/or aesthetic functions. To secure the sole unit to the midsole, the bottom surface of the midsole exposes receptacle areas or receptacle zones that are adapted to receive engageable elements protruding from the sole unit. The receptacles are incorporated in the midsole and may be made of a material that is less resilient than the surrounding midsole material. The system allows combining the functions of providing support and cushioning to the footwear in a single layer. This system also creates a lighter shoe because no outsole frame is needed and less material is needed to create a shoe sole. For example, heavier receptacle zones may be interspersed in a lighter midsole material. Additionally, the mounting of the sole unit directly into the midsole allows for a flush mounting of the sole unit to the midsole thereby creating an item of footwear with an overall thinner sole and enhanced aesthetic of the shoe, i.e., sleeker look along the side of the shoe. Also, the sole unit attaches to the midsole without exposure of engageable elements, for example along the sides, of the item of footwear. The engageable elements are locked into the midsole by arranging the sole unit onto the midsole so that by walking or pushing the sole unit against the midsole, the engageable elements will lock into the receptacle. The wearer can hear and feel the engageable elements click into place in the receptacles of the midsole.

As used herein, "footwear" refers to any item for supporting the foot and engaging the ground and encompasses shoes, sandals, boots, slippers, overshoes, athletic shoes, and other footwear articles. "Receptacle area," "receptacle zone," and "receptacle" refers to a structure or arrangement that is incorporated in a midsole and that has at least one material property that is different from a material property of the surrounding midsole. "Incorporated" refers to the receptacle being securely formed or fixed in the surrounding midsole material, for example by molding, bonding, or other suitable techniques. The specific material properties and structure of the receptacles provide an engagement/disengagement system. The receptacles may have material properties that allow the structure to return or tend to return to a prior or original position so that it contributes to the lodging of an engageable element in the midsole. The differences in material properties may be, for example, differences in resilience, hardness, flexibility, and/or weight of the materials. For example, materials such as EVA (Ethylene vinyl acetate) or polyethylene foam may be made in different grades of material having different resiliency, hardness, density, or other differences in physical properties.

Figure 23:
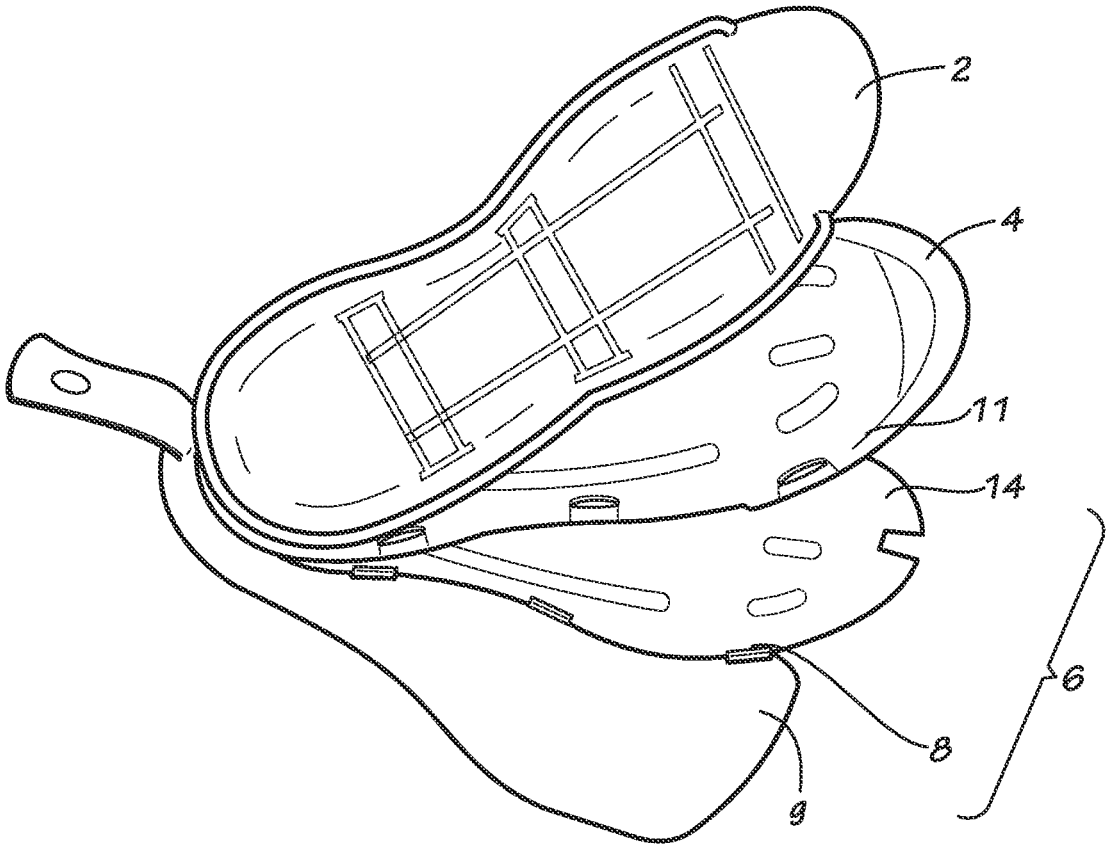
(PRIOR ART) FIG. 23
FIG. 23 shows a perspective view of the parts of an interchangeable sole system as known in the art.

FIG. 23 shows an example of a known interchangeable sole system. This sole assembly includes a sandwich structure of a sole unit receiver and an interchangeable sole unit. The sole unit receiver includes at least two layers with different material properties. The conventional sole unit receiver typically includes a midsole 2 and an outsole frame 4. The outsole frame 4 is a distinct layer of the sole unit receiver that is positioned between the midsole 2 and the sole unit 6 so that the outsole frame guides and holds engageable elements 8 of the sole unit 6. The outsole frame 4 typically includes a peripheral border 10 that surrounds the sole unit 6 when inserted. The sole unit 6 includes an outsole 12, such as a rubber outsole, attached to a plate 14, for example a hard plastic material, having engageable elements 8. Some sole assemblies have vertically extending engageable elements, in the form of pins that are guided and held by openings in the outsole frame and midsole. The pins are usually formed as extensions of the plate. The upper side of the pin ends in a horizontally extending component. To allow for engagement and disengagement of the pins to the sole unit receiver, the outsole layer is made of a firm material that holds and guides the pins. The outsole frame 4 also provides support and structure to the sole system when the sole unit 6 is engaged in the sole unit receiver. The midsole layer 2 provides cushioning to the sole system. In other interchangeable sole systems, the sole unit may be a unitary structure (e.g., molded unit) or it may be composed of two or more subcomponents combined together as a single unit (e.g. by adhesives or fasteners). The sole unit uses an interlocking tab and slot at the toe end, a strap and hook at the heel end, and engageable elements in between to prevent the sole unit from being pulled out of the footwear. The strap at the heel end of the sole unit may have a pullable element allowing the user to disengage the plate.

The midsole is usually a layer of material between a layer on which the foot rests, such as an insole or sock liner, and a ground-contacting sole. Typically, the midsole provides cushioning to the footwear, for example as a uniform layer of a foamed EVA material. The EVA material is generally soft and resilient and does not provide for a reliable and secure engagement of the engageable elements of the sole unit.

In contrast, a midsole, as used by the inventive subject matter, includes a single layer having a distinct zone or multiple distinct zones with material properties that are different from the material properties of the surrounding midsole material. The midsole is adapted to provide a secure engagement for the sole unit as well as to provide support to the footwear, without the need for an outsole frame, in combination with cushioning functions of the conventional midsole layer. In some embodiments, the midsole may connect to a shoe upper for enclosing or securing the shoe around a foot. The upper could be a complete enclosure that surrounds a foot or it could be a partial enclosure such as a set of sandal straps.

In some embodiments, the sole unit and midsole may be coupled to each other by various configurations of male-female interconnections and/or interference-fit arrangements. Such elements may be referred to as "engageable elements." Generally, the various pairs of engageable elements may be distributed across a sole assembly in any manner or number provided that they reasonably securely engage the sole unit for purposes of an intended use of an item of footwear. For example, all male parts could be disposed on the sole unit and all female parts could be disposed on the midsole as receptacles, or vice versa. For example, receptacles may include male elements that protrude from a midsole bottom surface to engage complementary female elements on the sole unit. In some embodiments, the sole unit or the midsole could each have a set of male-female parts that engage corresponding parts on the other of the sole unit or midsole. In some embodiments, the engageable elements may include snap fit fasteners, hooks, etc.

As used herein, "to complement" or "complementary" means geometrically shaped and sized for snug interconnection, or a male or female part that is not so shaped and sized but has material properties such that it will conform to a male or female part to which it is being interconnected.

The engageable elements of the sole unit provide a bidirectional stop that helps prevent the movement of a surface of the sole unit relative to the midsole. As used herein, a "bidirectional stop" generally means stop that limits movement along at least one axis from either direction on the axis. For example, a bidirectional stop may be a set of elements that are disposed on portions of a sole unit and midsole that are intermediate the end portions of the sole unit and midsole and that engage each other so that forward and rearward travel of the sole unit relative to the midsole is limited. The bidirectional stops may also limit relative movement of each sideways.

In the embodiments shown, the sole unit and midsole are coupled by engageable elements that protrude from the sole unit and that interact with a complementary structure in a portion of the receptacle, such as a recess, cavity, passage, or other complementary engageable element that holds or guides the engageable element to provide a bidirectional stop. The material properties of the receptacle allow the receptacle to provide a secure grip that holds the engageable elements in place once engaged and the sole unit is in use. The engagement is sufficient to resist forces on the sole unit that arise during ordinary use of the shoe. However, the sole unit may be removed when additional forces are applied to the sole unit, for example by pulling a strap at the rear of the sole unit downward to remove the sole unit. In some embodiments, one or more receptacles are incorporated in the midsole and exposed along a bottom surface of the midsole. In other possible embodiments, the receptacle may be cradled by or embedded in the midsole material.

FIGS. 1-22 show possible embodiments of interchangeable sole systems for footwear and midsoles. In some embodiments, the item of footwear may include an upper, an insole, a midsole, and a removable sole unit. The upper holds the shoe to the foot and varies with the style of the item of footwear depending (e.g., shoes, boots, sandals, slippers). In some embodiments, the sole unit may be removed by pulling a strap 64 at the heel portion 66, for example as shown in FIGS. 1-4, 10, and 15. The front of the sole unit may slide into a slot 98 in midsole 20 and located below the toes of a wearer. The sole system may use a sole unit as known in the art, for example a sole unit similar to the one shown in FIG. 23. Some existing sole units may use vertically extending pins, for example a total of six vertically extending pins may extend along lateral and medial sides of the sole unit. In some embodiments of the inventive subject matter the receptacle of the midsole may be adapted to interact with such pins.

The sole assembly includes a forefoot section, midfoot section, and rearfoot (or heel) section. The sole assembly further includes a lateral half and a medial half.

FIGS. 1-15 show an embodiment of an interchangeable sole system 16 including a sole unit 18, a midsole 20, and an insole 74. The midsole 20 has receptacles 22 in the form of pods 24*a-f* embedded along the periphery 26 of midsole 16, for example along a lateral periphery 28 and a medial periphery 30 of the midsole 16, and exposed at a bottom surface 32 of midsole 16. The receptacles 22 may have different shapes and include, for example, preformed slots, cavities, or depressions. Receptacle 22 are arranged and configured to receive engageable elements 32 of a sole unit 18 when the sole unit is attached. For example, receptacles 22 may include a portion defining a cavity 38 adapted to complement and removably hold male engageable element 32 extending from a sole plate 34 of sole unit 18. Sole plate 34 may be coupled to a traction outsole 78.

Figure 5:
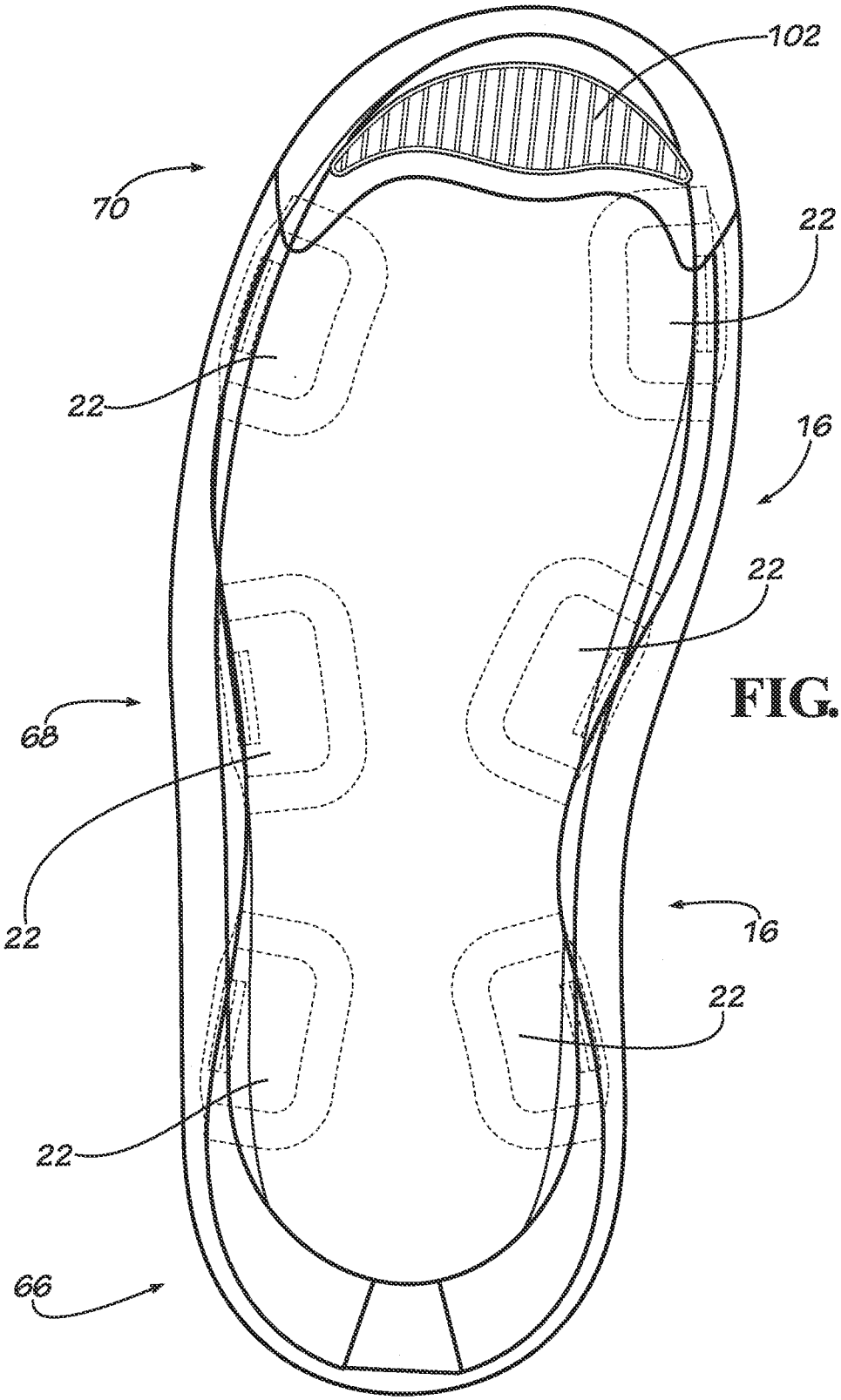
FIG. 5 shows a top view of the midsole with the receptacle areas indicated in dashed lines.
Figure 6:
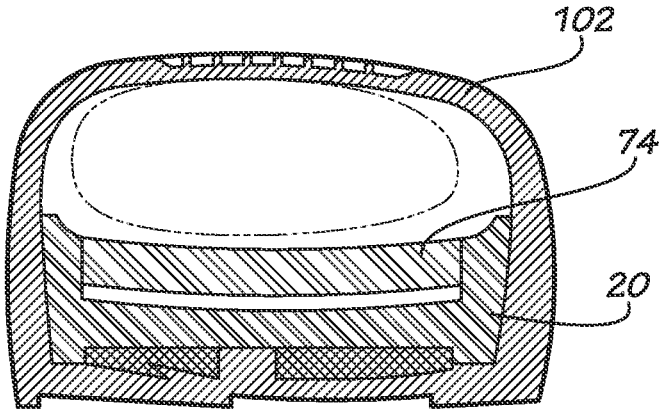
FIG. 6 shows a cross-sectional view along the lines 6-6' in FIG. 1.
Figure 15:
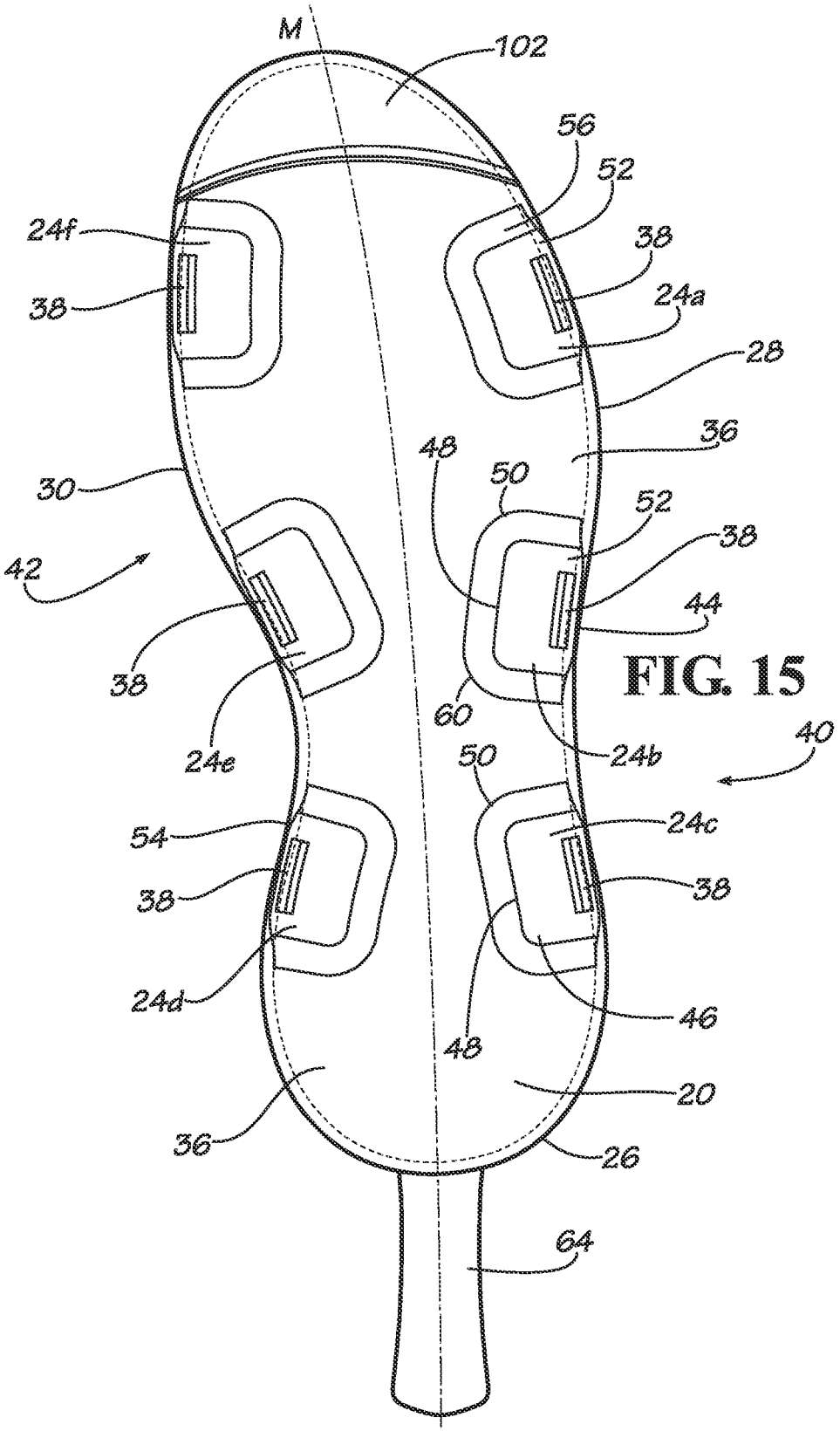
FIG. 15 shows a bottom view of the midsole of FIG. 1 with receptacle exposed.

FIGS. 5 and 15 show a total of six pods 24*a-f* on a bottom surface 36 of midsole 20 and located along periphery 26 of midsole 20. For example, three pods 24*a*, 24*b*, and 24*c* are positioned along the lateral side 40 of midsole 20 and three pods 24*d*, 24*e*, and 24*f* are positioned at the opposite side of the midsole at the medial side 42. Pods 24*a-f* have a generally rectangular shape 46 with a long side 48 of rectangular shape 46 facing an edge 44 of midsole 20. The generally rectangular shape 46 has rounded corners 50 and 50*b* on the side of rectangular shape 46 facing a midline M of midsole 20 and generally right angles 52 along edge 44 of midsole 20. Pods 24*a-f* have a narrow rectangular cavity 38 provided close to edge 44 of midsole 20. In some embodiments, pods 24*a-f* may curve outward towards the sides of the midsole, for example a gradual curve 54 slightly outward of the long side 48 of rectangular shape 46 towards edge 44 of midsole 20 to accommodate cavity 38 for holding or supporting an engageable element. FIG. 5 shows a top view of midsole 20 indicating the perimeter of pods 24 in dashed lines. The area or zone covered by pod material is sized to accommodate the engageable elements of the sole unit and has a support zone surrounding the cavity. FIGS. 1-15 show pods 24*a-f* having a width of about 2 cm and a length of about 3 cm.

In some embodiments, pods may have transition areas between the pod material and the midsole material. For example, as shown in FIGS. 5, 7A, 9, 13 and 15, a sloped transition area 56 is formed by a gradual thinning of the pod material around the periphery of the pod, for example, towards midline M of midsole 20.

Figure 7A:
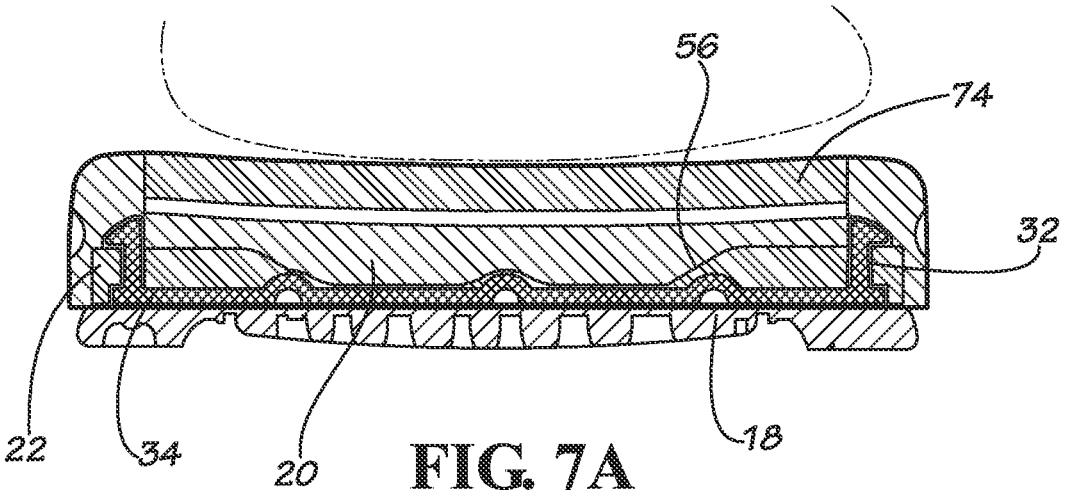
FIG. 7A shows a cross-sectional view along the lines 7A-7A' in FIG. 1.
Figure 7B:
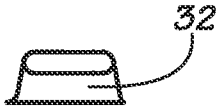
FIG. 7B shows a detail of an engageable element of the sole unit of FIG. 1.
Figure 8:
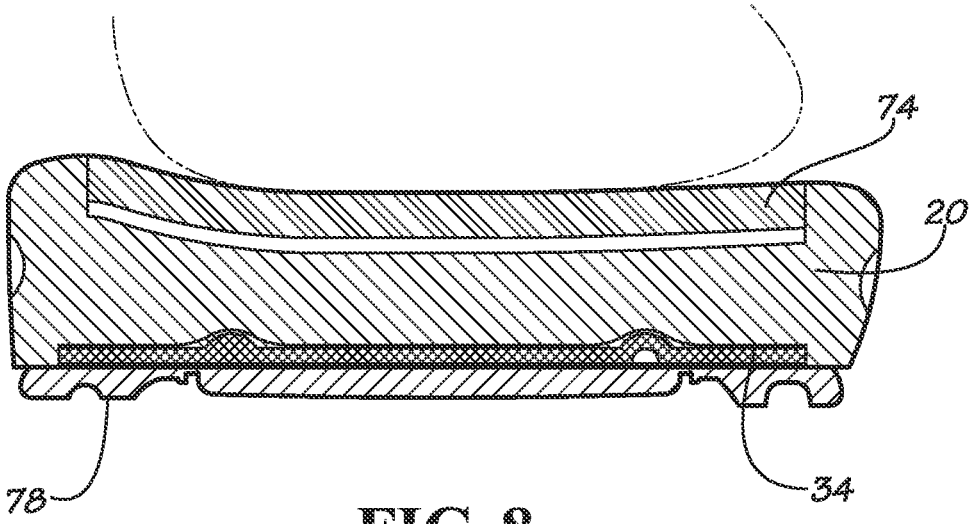
FIG. 8 shows a cross-sectional view along the lines 8-8' in FIG. 1.
Figure 9:
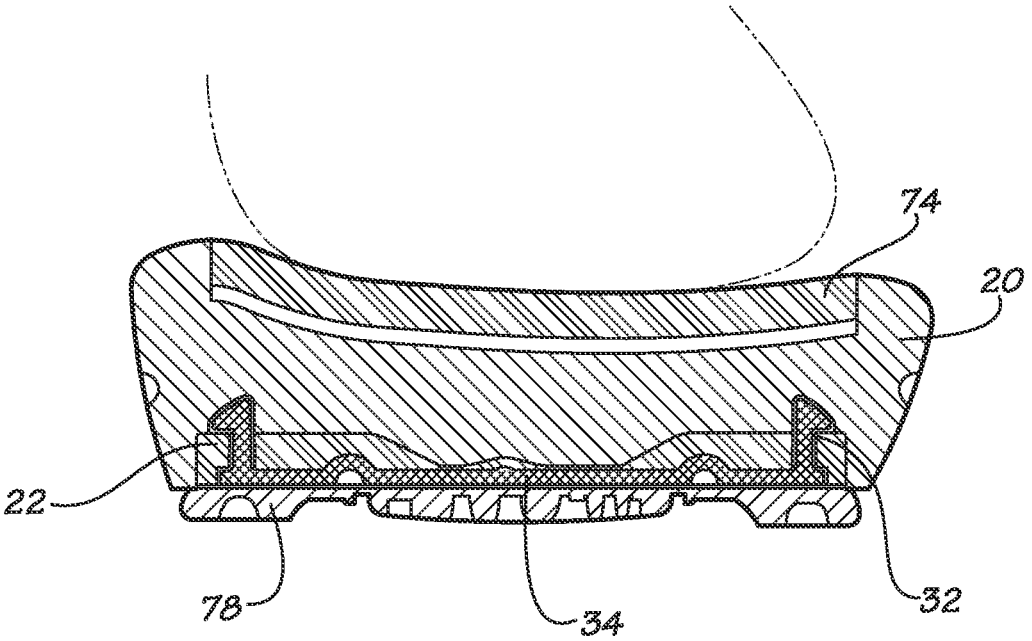
FIG. 9 shows a cross-sectional view along the lines 9-9' in FIG. 1.
Figure 10:
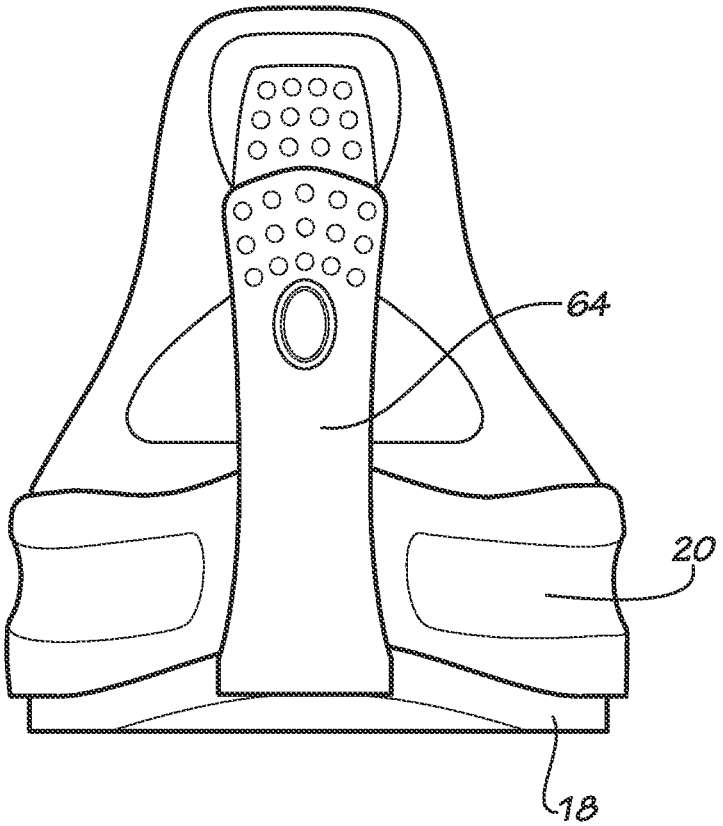
FIG. 10 shows a back view of the interchangeable sole system of FIG. 1.
Figure 11:
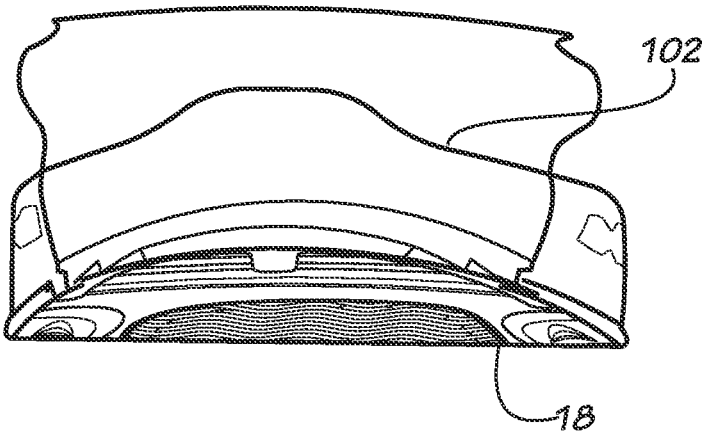
FIG. 11 shows a front view of the interchangeable sole system of FIG. 1.
Figure 12:
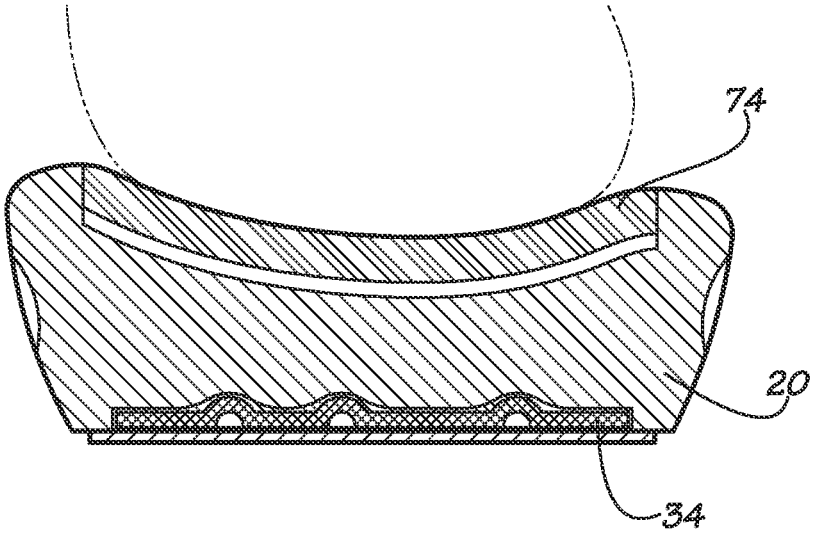
FIG. 12 shows a cross-sectional view along the lines 12-12' in FIG. 1.
Figure 13:
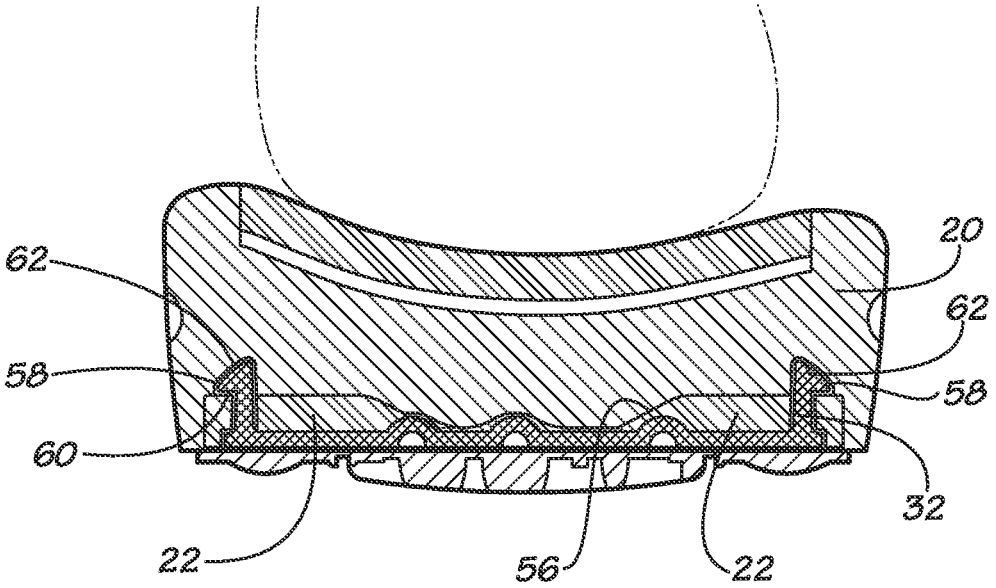
FIG. 13 shows a cross-sectional view along the lines 13-13' in FIG. 1.
Figure 14:
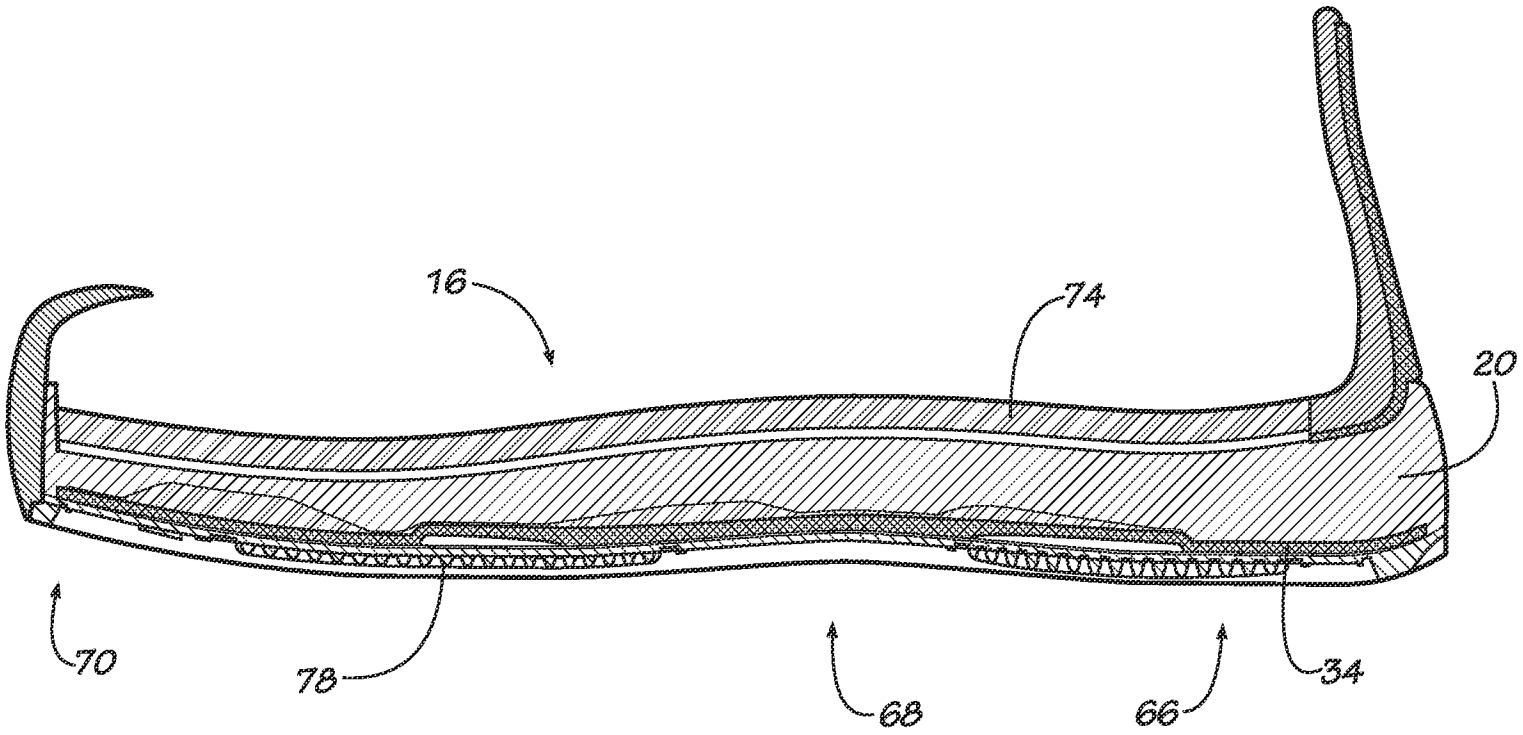
FIG. 14 shows a cross-sectional view along the lines 14-14' in FIG. 1.

FIGS. 7A, 9, and 13, illustrate how engageable elements 32 of sole unit 18 interact with portions of receptacle 22. Receptacle 22 has a cavity 38 that extends vertically through the pod material. Cavity 38 allows pin 32 to extend vertically beyond the pod material into the more resilient midsole material. A horizontally extending component 58 of pin 32 may rest on an upper surface 60 of pod 24. Horizontally extending component 58 and end 62 of pin 32 may be surrounded by midsole material. For example, in some embodiments a pin made of nylon may snap and lock into a hole that is framed in rubber. In other embodiments, the receptacle may have a recess to hold the pin, and receptacle material may surround the pin either entirely or partially. For example, the pin may be encapsulated by receptacle material.

The interchangeable sole system includes a sole unit that is generally sized to fit with and complement the midsole. The midsole may or may have not a peripheral border to contour the sole unit. In some possible embodiments, there may be a partial peripheral border. In other embodiments, the footwear may include a single sole unit or a plurality of sole units that are separated with different properties, e.g., varying traction or durometer, and the use of a specific sole unit may be depend on the activity. Use of separate sole units allows for a user to customize the sole properties, e.g., to compensate for pronation or to provide more or less traction in different areas of the foot, for example, in forefoot, midfoot and/or rearfoot locations. In other embodiments, sole units may be positioned at lateral and/or medial sides of the footwear.

In some embodiments, the sole unit may have a uniform thickness. In other embodiments, the thickness of the sole unit may vary, for example, the sole unit may have a heel portion that is raised to provide a boot heel or a central portion might be recessed to provide cushioning. The same effect may be accomplished by variations in the thickness of the midsole.

The midsole may be made of a generally compressible material, such as a shape retentive, flexible polymer or foamed material. In some embodiments, the midsole material may have a hardness with a durometer ranging between about 55 Asker C and about 65 Asker C, for example, a hardness of about 60 Asker C. The receptacle may include a material with a hardness ranging between about 75 and about 85 Shore A durometer, for example, a hardness of about 80 Shore A durometer. These numbers are intended to be example durometers, and durometers of varying degree may be appropriate, depending on the specific application to be pursued. Examples of suitable materials include rubbers, foams, elastomers, visco-elastomers, plastics, natural and synthetic leathers, textiles, fibers and metals. Some of these materials may come in different densities making them suitable both as midsole material and as receptacle material. In some embodiments, a combination of materials may be used. In other possible embodiments, a midsole may have receptacles that are formed by a gradual change in material properties, for example, material properties may transition gradually between the midsole and receptacle area(s).

In some embodiments, a firm midsole material may include areas that provide for engageable elements that are complementary to engageable elements on a sole unit.

Optionally, a sole unit or midsole may include cushioning elements. "Cushioning materials" and "cushioning elements" refer to basic shock absorbing, energy return, and/or protective underfoot materials or structures that are intended to react to the forces of foot strike by providing force attenuation, dissipation, dampening, or energy return (spring), which are typically included on sports and athletic shoes. For example, a cushioning element may include a consistent and uniform layer of shock absorbing and protective material, such as EVA or polyurethane, placed in a shoe between the foot and the ground, or customized placements of varying cushioning materials and structures under a foot, or may be based on EVA or polyurethane foam, visco-elastomers of foam or gels, fluid filled bladders, mechanical springs or resiliently collapsible mechanical structures, fluid (e.g., air) springs, or any combination of the foregoing.

The flexibility of the midsole and/or sole unit may vary according to the demands of a particular user or intended use. For example, the midsole or sole unit may be provided with more support on a medial side to help a runner whose foot pronates. Likewise the midsole or sole unit may be provided with more support on a lateral side to compensate for a runner whose foot supinates. Additionally, a midsole or sole unit may be constructed with a material that provides resistance to environmental conditions such as sharp objects or corrosive chemicals for safety in work places where such conditions may be present.

In some embodiments, midsoles may also have flexural lines corresponding to the lines of flex in a foot. The flexural lines may provide a balance between stiffness and flexibility. In some embodiments, flexural lines may be formed by the removal of midsole material or by ridges of deposit of midsole material. In other embodiments, longitudinal ribs may be provided including a different kind of material. For example, some sole units may have longitudinal protrusions or ridges that are complemented by corresponding indentations in the midsole or receptacle zones. In some embodiments, for example for wading boots, the midsole and/or sole unit may include channels, ridges or drain ports that channel water away from the shoe and thereby prevent water absorption by the shoe, enhance drying of the shoe, reduce overall weight of the shoe and lead to more comfort and less fatigue for the wearer.

Figure 21:
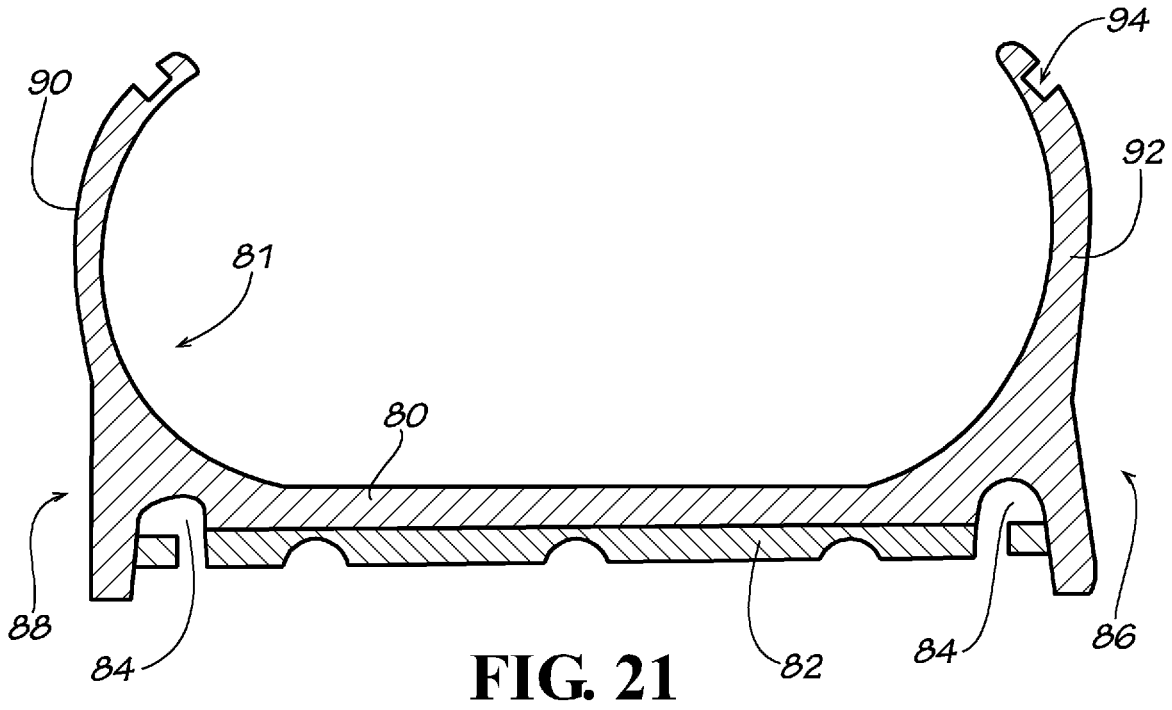
FIG. 21 shows a sketch of a cross-section of a midsole including a cupsole according to another embodiment, and the cross-section being taken at a location similar to the cross-section of FIG. 19.

In another possible embodiment, the midsole may include a cupsole or otherwise be part of a cupsole construction. A cupsole construction refers to a molded, contoured sole with vertically upward extending sidewalls along the perimeter of the shoe. The sidewalls are usually stitched to the outside of the shoe upper. For example, FIG. 21 shows a cross-section of a sole including a midsole 80 in the form of a cupsole 81 and a receptacle zone 82. Receptacle zone 82 may be similar to the receptacle zone 72 of the embodiment shown in FIG. 19, and may include recesses 84 along lateral side 86 and medial side 88 of cupsole 80 to accommodate engageable elements of a sole unit. The cross-section shown in FIG. 21 is taken along a section of the sole unit similar to the area indicated by the line J-J' in FIG. 19. Cupsole 80 has upwardly extending sides 90, 92 with a stitch groove 94 at the upper end of each side for stitching cupsole 80 to a shoe upper. In other embodiments, the cupsole may be attached to the shoe upper by any other suitable fastening or joining methods. The cupsole may be formed of any suitable cupsole material, for example, thermoplastic rubber, thermoplastic polyurethane, ethylene-vinyl acetate, etc. In other possible embodiments, the midsole may include a shell portion, for example, integrated with the shoe upper.

Located in the midsole at the toe end may be a slot adapted to accommodate a tab at the toe end of the sole unit. The tab fits into the slot of the midsole when the sole unit is inserted into the cavity. The slot may be made of midsole material, receptacle material, or any other suitable material. The slot may be a thin slot integrated into the midsole or may be formed as a distinct piece attached to the midsole.

In some embodiments, a ledge may extend from the midsole below the slot. For example, FIGS. 1, 4, 5, 11, and 14 shows a ledge 96 extending from a midsole 20 and forming a slot 98 adapted to receive tab 100 of sole unit 18. In some embodiments, the sole unit may have a recess below the tab which is configured to receive the ledge when the sole unit is attached to the midsole. Thus, the tip of the sole unit may have a recess that overlaps the ledge and prevents, for example, sand from working its way into the slot and forcing the tab outwardly causing a discontinuity between the outer surface of the sole unit and the outer surface of the sidewall at the toe end of the footwear. In some embodiments, the toe end of the midsole and the toe end of the sole unit may include one or more sets of releasably engageable or interlocking elements, such as interlocking teeth 76, shown in FIG. 4. A first set of teeth may be disposed on a surface of the sole unit and a second set may be disposed on a surface of the sole unit receiver. To make the teeth engageable and releasable from a complementary set within the slot, they may be formed of a flexible material. Optionally, both surfaces of the sole unit may have teeth, and there may be complementary sets of teeth on both surfaces of the slot in the midsole. For example, the teeth in the upper surface of the slot in the midsole may be formed in a layer of EVA midsole material and the teeth on the upper and/or lower surface of the sole unit may be formed in a thermoplastic that serves as a base layer for supporting a rubber out sole. By using upper and lower sets of teeth, a more secure interlock is achieved no matter which way the sole unit may flex within the sole unit receiver. Sets of complementary teeth may be disposed not only at the forefoot of the sole assembly but virtually at any other location in the assembly. For example, there could be sets running along lateral and medial sides of the sole assembly, or in the rearfoot portion.

In some possible embodiments, a toe cap may be provided to the midsole as a distinct structure, while in other possible embodiments it may be integrated as part of the midsole. For example in the embodiment shown in FIGS. 1-15, the sole system includes a toe cap 102 coupled to midsole 20.

Figure 17:
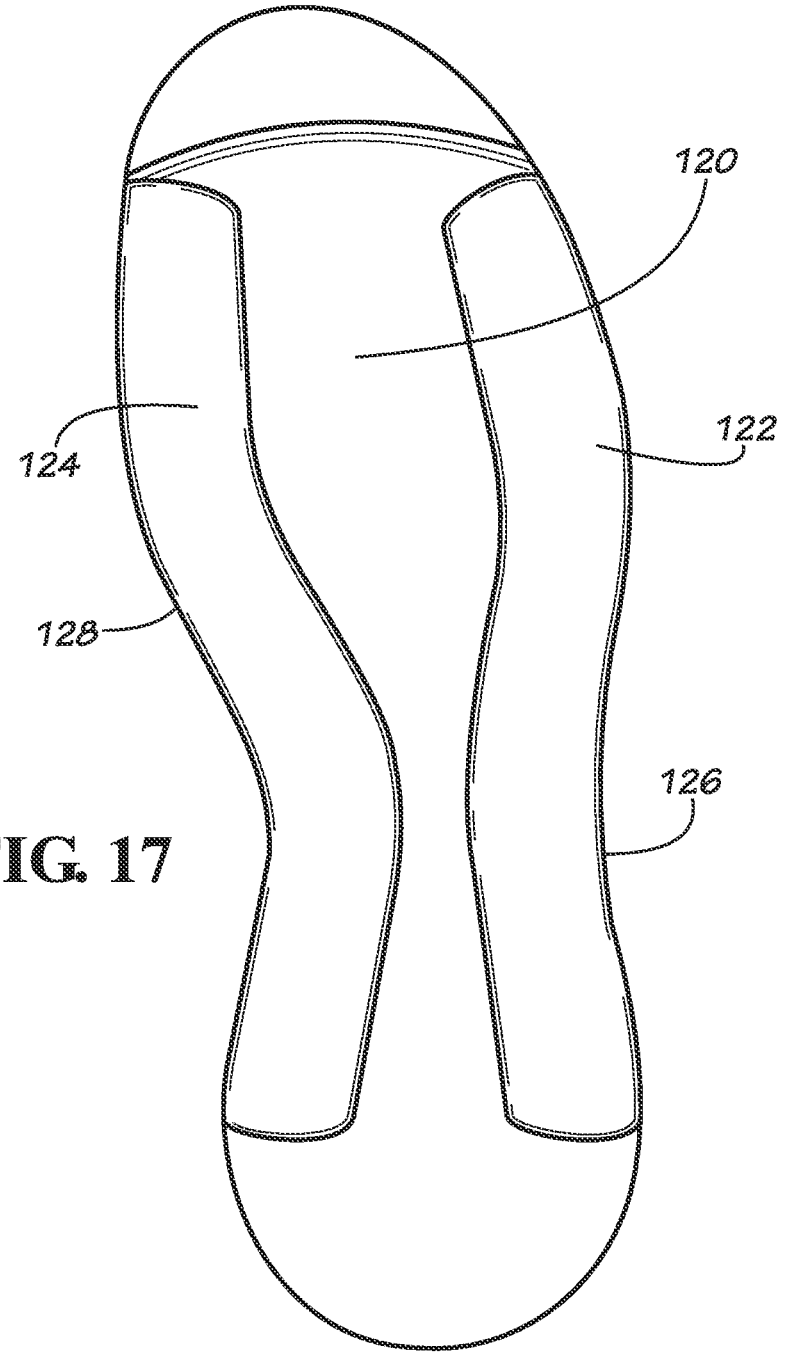
FIG. 17 shows a bottom view of a midsole of another embodiment of a sole system including a midsole with a receptacle having a strip design.
Figure 18:
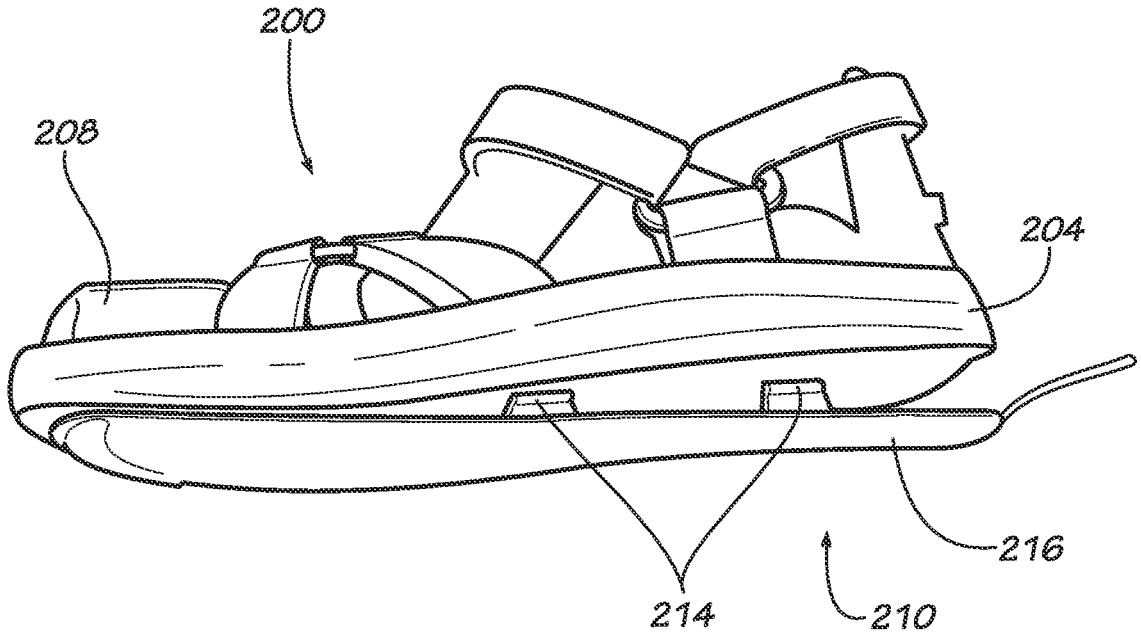
FIG. 18 shows a side view of another embodiment of an interchangeable sole system incorporated in a sandal and having the sole unit partially removed at the heel and midfoot portions of the midsole.
Figure 19:
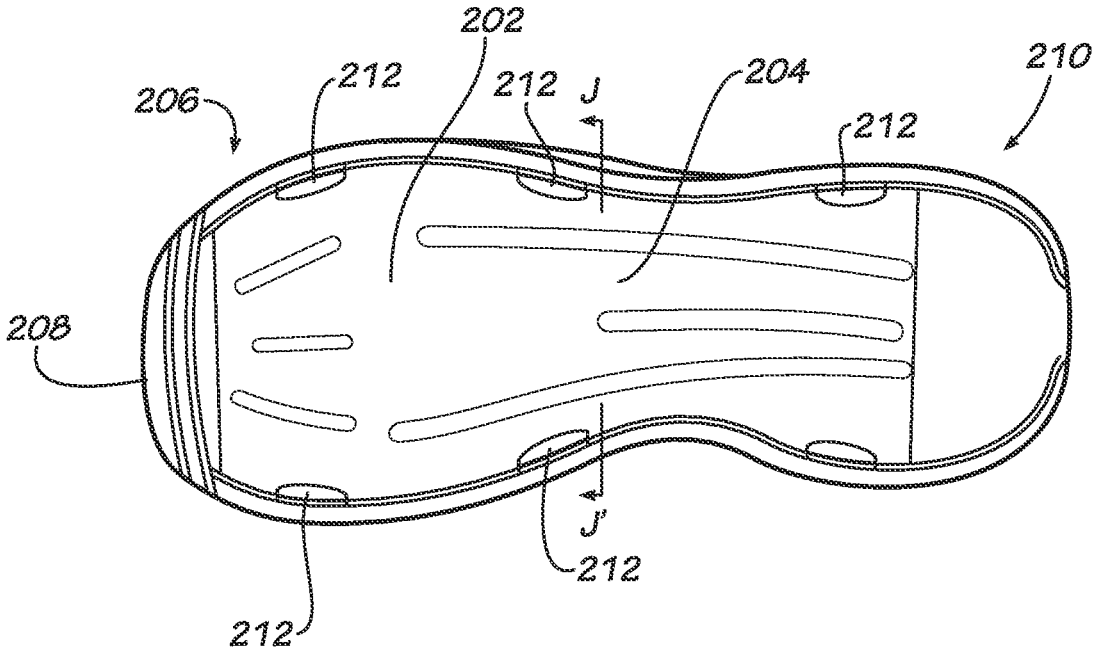
FIG. 19 shows a bottom view of the midsole of the embodiment shown in FIG. 18.
Figure 20:
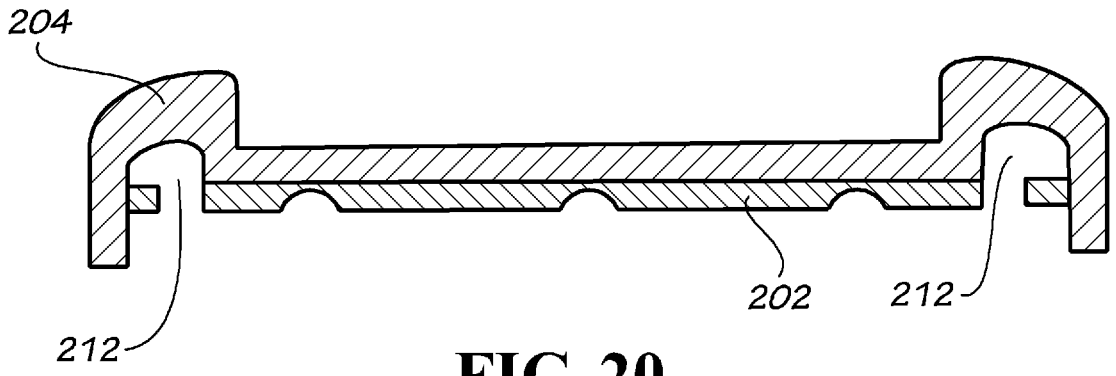
FIG. 20 shows a cross-sectional view of the midsole of FIGS. 18 and 19 taken along the lines J-J' of FIG. 19.

In another possible embodiment, a midsole may include receptacles in the form of a strip covering an area associated with engageable elements of the sole unit. An example of such a design is shown in FIG. 17, wherein midsole 120 includes two continuous strips 122 and 124 of a rubber material, one along lateral side 126 of midsole 120 and one along medial side 128 of midsole 120. These strips of material provide a support zone and an area along the sides of the shoe wherein possibly three pairs of engageable elements connect the outsole to the midsole. The engaging element may connect to the midsole in a manner similar to the one shown in FIGS. 12 and 13. In other possible embodiments, receptacle zones may be dispersed as intermittent zones along the periphery of the midsole. In yet another possible embodiment, a receptacle zone may be any zone covering a section of the sole wherein the complementary structures for the engageable elements are located. Such a zone may span from lateral to medial sides along a midfoot section or beyond. An example of such a midsole structure is shown in FIGS. 18, 19, 20. A sandal 200 is provided with a midsole 204 having a receptacle zone 202 that is incorporated in midsole 204. In some embodiments, midsole 204 may be made of an EVA material with a receptacle zone 202 made of a rubber material embedded in the midsole. Receptacle zone 202 covers an area of the sole from approximately a forefoot section 206 below a toe cap 208 to approximately the beginning of a heel section 210. In some embodiments, the thickness of the receptacle zone may vary. For example, the receptacle zone may have a thicker layer of rubber material provided in the areas having the recesses and less material in areas without recesses. FIG. 19 shows a bottom view of midsole 204 with receptacle zone 202 embedded in midsole material. FIG. 20 shows a cross-sectional view of midsole 204 along line J-J' indicated in FIG. 19. Recesses 212 for engaging pins 214 of a sole unit 216 are formed in receptacle zone 202 and extend from a bottom surface to an upper surface. FIG. 19 shows how a toe cap 208 may be attached to and integrated with midsole 204.

Figure 16:
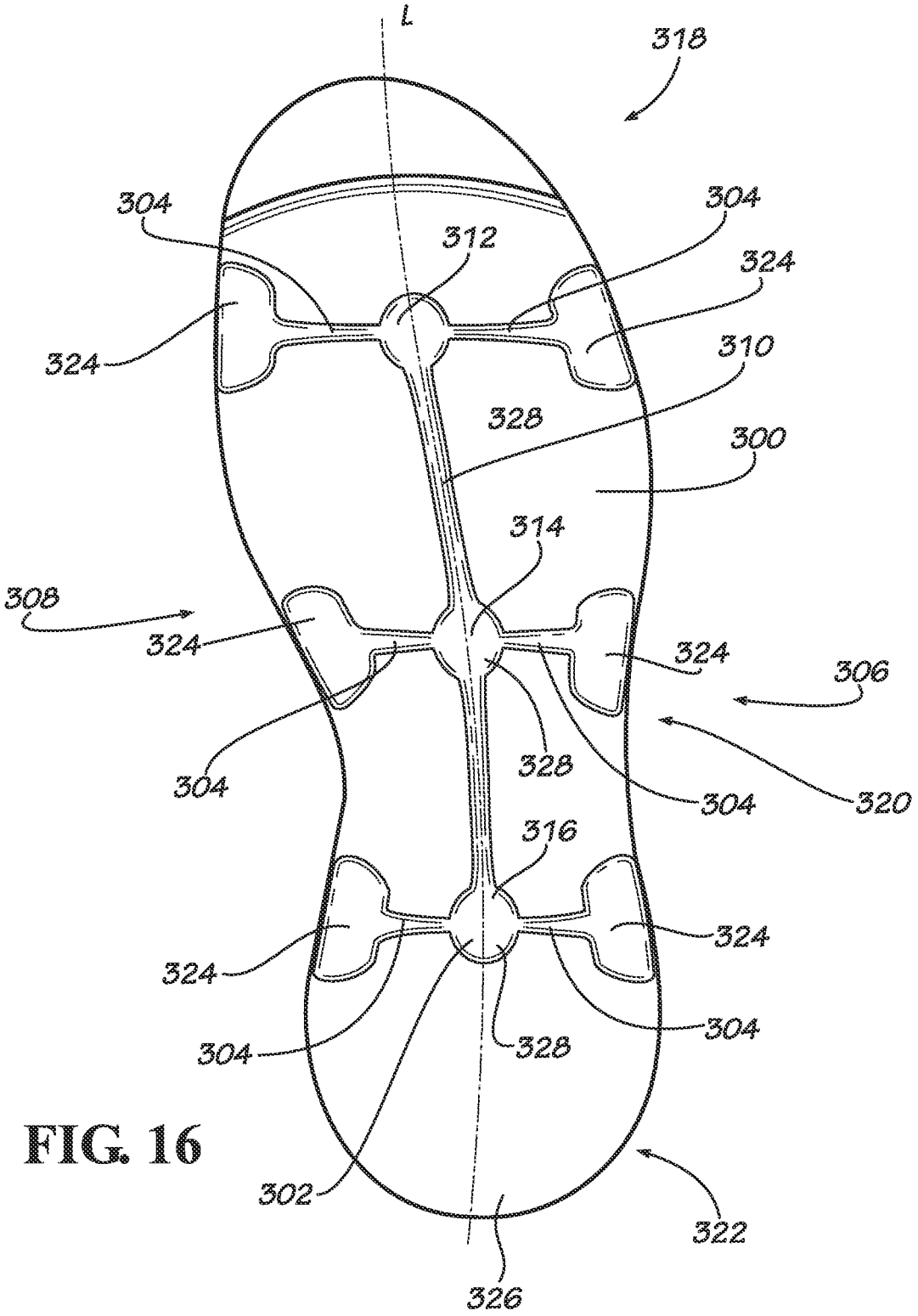
FIG. 16 shows a bottom view of a midsole according to another embodiment of a sole system including a midsole with a receptacle having a web design.

In another possible embodiment, receptacles in a midsole may take the form of a web-like structure. For example, as shown in FIG. 16, midsole 300 may have a frame 310 including a spine 302 and fingers 304. Spine 302 may be formed, for example, of a thermoplastic polyurethane or a rubber material along a midline L of midsole 300. Fingers 304 extend to a lateral side 306 and a medial side 308 of midsole 300. Frame 310 has three transverse areas or zones 312, 314, and 316, running along a lateral-medial line, and interconnected longitudinally. A first zone 312 is located in forefoot section 318, a second zone 314 is located in a midfoot section 320, and a third zone 316 is located towards a heel area 322 of the midsole. Frame 310 has generally rectangular portions 324 along a periphery 326 of midsole 300. Generally rectangular portions 324 are adapted to allow elongated engagement members of an outsole to connect to midsole 300. Along midline area L of midsole 300, the central connections of the frame have round/oval shaped areas 328 made of a material that may be different from the rest of the midsole material. Optionally, lateral-medial interconnection may be provided in the midsole, for examples as indicated in FIG. 16 by fingers 304. In other embodiments, receptacles may be interconnected by a variety of areas or zones or they may not be interconnected at all.

Figure 22:
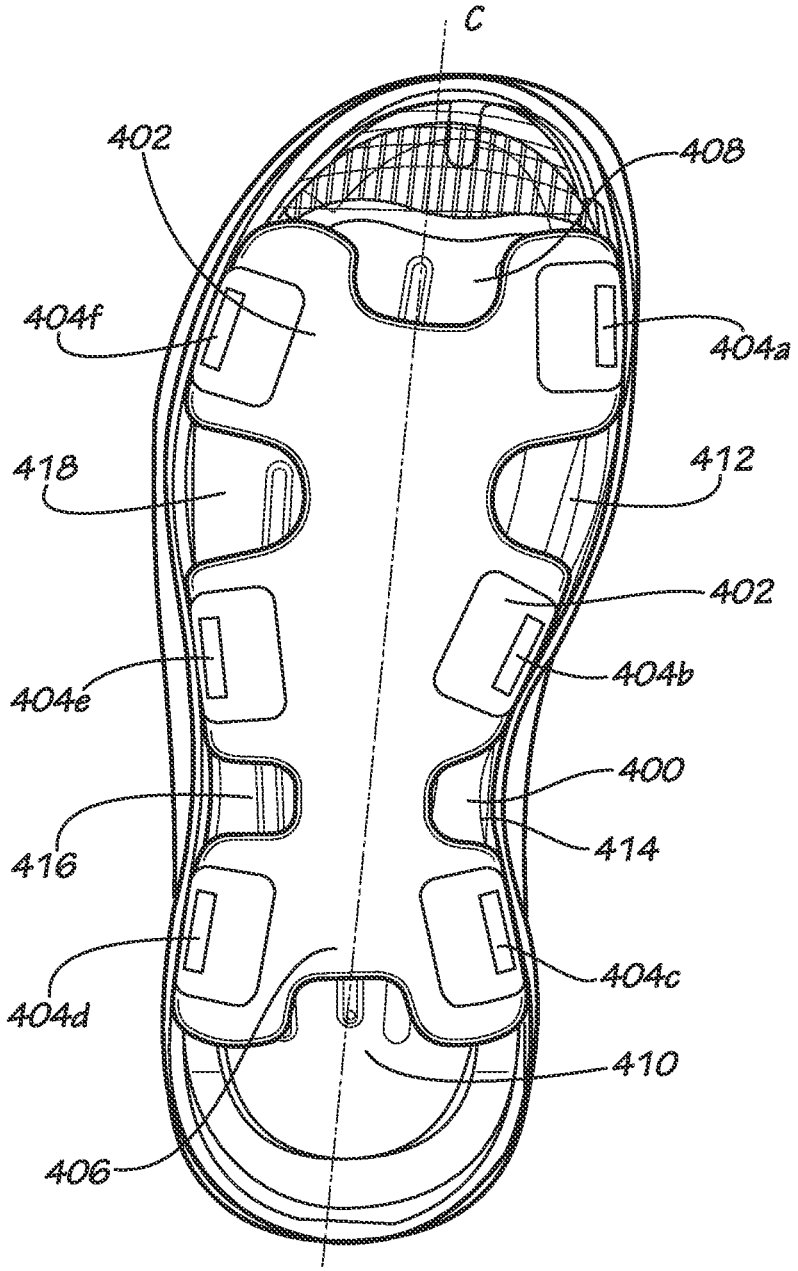
FIG. 22 shows a bottom view of a midsole of another embodiment of a sole system including a midsole with an expanded web design.

Another example of another possible lay-out for receptacles in a midsole is shown in FIG. 22. The lay-out of the receptacle zone may be seen as an intermediate between the lay-out shown in FIGS. 18, 19, 20 and the web design of FIG. 16. FIG. 22 shows a bottom view of a midsole 400 with receptacle areas 402 that reinforce the area around recesses 404*a-f* for engaging pins of a sole unit along both lateral and medial sides of the midsole. Receptacle area 402 may extends along a central longitudinal area 406 of midsole 400. In the embodiment shown in FIG. 22 midsole material is exposed at a bottom surface of midsole 400 between recesses 404*a-f* along lateral and medial periphery. The contours of exposed areas 412, 414, 416, and 418 of midsole material curve inward from an outer perimeter of midsole 400 towards a midline C. Midsole material is also exposed in a forefoot section 408 and a rearfoot section 410 with contours of exposed midsole material following a curved indent along midline C. Engageable elements of a sole unit may interact with receptacle areas similar to the embodiment shown in FIGS. 12 and 13. For some items of footwear such an expanded web design may balance structural support provided by the receptacle zone and cushioning provided by the midsole material.

The inventive subject matter further contemplates a method of making an interchangeable sole system for an item of footwear by providing a midsole comprising a first material with a receptacle of a second material, and providing a sole unit having at least two engageable elements spaced along a peripheral portion of the sole plate, the receptacle adapted to engage the engageable element associated with the sole unit, and wherein the second material is less compressible than the first material so that the first material provides cushioning to the footwear while the second material allows for engagement and disengagement of the engageable elements of the sole unit to the midsole without the need for an outsole frame.

Contemplated fabrication methods for a midsole with receptacles may include molding, injection molding, direct-injection molding, one-time molding, composite molding, insert molding, co-molding separate materials, or other techniques known in the art, alone or in combination. Dampening elements may also be incorporated into the sole unit and/or midsole disclosed herein, for example, dampening elements that allow reducing the amplitude of oscillations, vibrations, or waves. Other possible embodiments may use a unitary midsole construction. For example, the entire periphery could be formed of a material that is less resilient than the rest of the midsole. In other possible embodiments, a midsole may have single or plural co-molded layers of material to form receptacles. In other possible embodiments, the midsole may have a laminated structure.

In one example embodiment, the midsole may be made based on a traditional midsole that is provided with recesses for forming the receptacle and a receptacle is stock fitted, for example glued to an EVA midsole. In other possible embodiments, a frame of receptacle can be made of a rubber material that is cemented into recesses in the midsole. Alternatively, the frame could be co-molded with the midsole. Examples of midsole materials may include EVA, polyurethane, neoprene, etc. Examples of receptacle materials may include thermoplastic polyurethanes, natural rubber, synthetic rubber, or combinations thereof. In other embodiments, the sole system may include a firmer midsole material that accomplishes both functions of cushioning and engagement/disengagement capacities.

In some embodiments, receptacle may be inserted into the midsole and embedded by methods that include adhesives, bonding agents, welding, mechanical bonding, interlocking shapes or other mechanical or chemical fastening means know to persons in the art, alone or in combination.

The footwear may be made by cementing, stitching, or other common bonding methods.

To facilitate the releasability or attachability of the sole unit to the midsole, one or more hand tools may be provided with or in the sole system. The hand tool generally is a structure or structures that are disposed on the footwear and can be pulled, pushed, turned or otherwise manipulated to cause the sole unit and sole unit receiver to engage or disengage. The hand tool may be located any place on the sole unit, but normally it would be placed in a manner that is not subject to wear and tear and does not interfere the performance or comfort of a shoe. Accordingly, it may be placed on a side, heel or front of a shoe, and it interfaces where a sole unit and sole unit receiver join together. It may also be recessed in the bottom of a sole assembly.

Footwear according to the inventive subject matter may come in many different styles. The durometer of the material, the number and shape of the engageable elements and corresponding receptacles and their location may vary, as well as the structure of the footwear.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

The invention claimed is:

1. An interchangeable sole system for an item of footwear comprising:

a midsole having a foot-facing top surface and an opposing, ground-facing bottom surface, and a plurality of spaced-apart receptacles that are fixedly and integrally embedded in and exposed from the ground-facing bottom surface of the midsole and along a lateral and medial periphery of the midsole, and wherein the exposed receptacles each include a cavity that has an opening formed in and parallel to the ground-facing bottom surface of the midsole and which recesses below a general surface of the exposed receptacle, the cavity being adapted to complement and removably hold a corresponding male engageable element on a removeable sole unit;

a removable sole unit having a plurality of spaced-apart male engageable elements projecting upwardly from a general plane of an upper surface of the sole unit;

wherein for each receptacle, the cavity is formed and defined in a zone portion of receptacle material that extends horizontally outwardly from the cavity and separates the cavity from the midsole horizontally surrounding the receptacle, the zone portion having a resiliently compressible material, thereby resiliently conforming to the corresponding male engageable element on insertion of the male engageable element into the cavity so that the receptacle contributes to the lodging of the engageable element to the midsole and to its removability;

wherein the midsole surrounding the zone portion has a material property that provides more cushioning than the material of the zone portion, the zone portion providing a separation of the cavity and surrounding midsole so that the receptacle can removably hold the male engageable element during use independently of the material properties of the midsole; and wherein the sole unit is coextensive with at least a forefoot or rearfoot portion of the midsole.

2. The system of claim 1 wherein the midsole comprises a first material and the receptacle comprises a second material, and wherein the second material is less resilient than the first material, and wherein the second material is molded with and thereby fixedly and integrally embedded in the first material.

3. The system of claim 2 wherein the midsole comprises a material having a first durometer and the receptacle comprises an elastomeric material having a second durometer, and wherein the first durometer is less than the second durometer.

4. The system of claim 1 wherein the midsole comprises a foamed material and the receptacle comprises an elastomeric material.

5. The system of claim 3 wherein the first durometer ranges between about 55 Asker C and about 65 Asker C.

6. The system of claim 3 wherein the second durometer ranges between about 75 Shore A and about 85 Shore A.

7. The system of claim 1 wherein a plurality of first receptacles are located along a medial periphery of the footwear and a plurality of second receptacles are located along a lateral periphery of the footwear.

8. The system of claim 7 wherein at least one receptacle is located in a rearfoot section, at least one receptacle is located in a midfoot section, and at least one receptacle is located in a forefoot section of the item of footwear.

9. The system of claim 1 wherein the midsole further comprises at least one surface portion with a plurality of rows of teeth running generally perpendicular to the longitudinal axis of the midsole and the surface portion is adapted to engage a set of complementary teeth on the sole unit.

10. The interchangeable sole system of claim 1 wherein the male engageable elements have a horizontal portion projecting off a vertical portion and project from the surface of the sole unit.

11. The interchangeable sole system of claim 1 wherein the midsole consists of a single layer of a molded material with the receptacles co-molded therein.

12. The interchangeable sole system of claim 1 wherein for a given receptacle, midsole material not only surrounds the receptacle horizontally but is also vertically disposed over and adjacent an end to the cavity that is opposite the opening in the ground facing surface, the adjacent midsole having a slit that can receive an end of the male engageable element placed into the cavity.

13. The interchangeable sole system of claim 12 wherein the slit has a horizontal aspect for receiving a horizontal portion of the male engageable element that extends outwardly from a vertical portion of the male engageable element.

14. The interchangeable sole system of claim 1 wherein the receptacles have a generally rectangular shape and the cavities are narrow in form.

15. A method for making a midsole for an item of footwear provided with an interchangeable sole system, comprising:

forming a midsole having a foot-facing top surface and an opposing, ground-facing bottom surface; and forming a plurality of spaced apart female engageable elements in the midsole, the female elements comprising receptacles in the form of pods fixedly and integrally embedded along a lateral and medial periphery of the midsole;

wherein the receptacles each include a cavity that has an aperture at the ground-facing bottom surface of the midsole and which recesses below a general surface of the midsole material; and wherein a material property of the receptacles differs from a material property of the midsole so that the midsole provides cushioning to the item of footwear, and the receptacles allow for engagement and disengagement of a plurality of male engageable elements, which correspond to the plurality of female engageable elements, to the midsole;

wherein for each receptacle, the cavity is formed and defined in a zone portion of a receptacle material that extends horizontally outwardly from the cavity and separates the cavity from the midsole horizontally surrounding the receptacle, the zone portion having resiliently compressible material, thereby resiliently conforming to the corresponding male engageable element on insertion of the male engageable element into the receptacle so that the receptacle contributes to the lodging of the engageable element to the midsole and to its interchangeability; and wherein the midsole surrounding the zone portion has a material property that provides more cushioning than the material of the zone portion, the zone portion providing a separation of the cavity and surrounding midsole so that the receptacle can interchangeably hold the male engageable element during use independently of the material properties of the midsole.

16. The method of claim 15 wherein the receptacle is incorporated into the midsole by co-molding with surrounding midsole material.

17. The method of claim 15 wherein the receptacle is stock-fitted to surrounding midsole after molding the receptacle, and wherein the receptacle comprises a foamed polymer material.

18. The method of claim 15 wherein the receptacle comprises an elastomeric material having a higher durometer than surrounding midsole material.

19. An interchangeable sole system for an item of footwear comprising:

a midsole having a foot-facing top surface and an opposing, ground-facing bottom surface, and a plurality of spaced-apart receptacles that are fixedly and integrally formed in and exposed from the ground-facing bottom surface of the midsole, wherein the exposed receptacles each include a cavity that has an opening formed in and parallel to the ground-facing bottom surface of the midsole and which recesses below a general surface of the exposed receptacle, the receptacle being adapted to complement and removably hold a corresponding male engageable element on an interchangeable sole unit;

an interchangeable sole unit including a body portion, a traction outersole covering a bottom surface of the body portion, and a plurality of spaced-apart male engageable elements projecting upwardly from a general plane of the bottom surface, the sole unit being selectively attachable at the bottom surface of the midsole;

wherein each cavity is configured to receive the corresponding male engageable element of the sole unit and secure the sole unit to the midsole when the male engageable elements are received in their corresponding receptacles;

wherein the traction outersole is disposed entirely beneath the bottom surface of the midsole and the body portion of the sole unit, and the traction outersole covers a lateral bottom surface and a medial bottom surface of the midsole, when the engageable element is received in the cavity and the sole unit is selectively attached to the midsole at the bottom surface of the midsole;

wherein for each receptacle, the cavity is formed and defined in a zone portion of a receptacle material that extends horizontally outwardly from the cavity and separates the cavity from the midsole horizontally surrounding the receptacle, the zone portion having resiliently compressible material, thereby resiliently conforming to the corresponding male engageable element on insertion of the male engageable element into the receptacle so that the receptacle contributes to the lodging of the engageable element to the midsole and to its interchangeability; and wherein the midsole surrounding the zone portion has a material property that provides more cushioning than the material of the zone portion, the zone portion providing a separation of the cavity and surrounding midsole so that the receptacle can interchangeably hold the male engageable element during use independently of the material properties of the midsole.

20. An interchangeable sole system for an item of footwear comprising:

a midsole having a foot-facing top side and a ground-facing bottom surface and a plurality of spaced-apart receptacles that are fixedly and integrally embedded in and exposed from the ground-facing bottom surface of the midsole and along a lateral and medial periphery of the midsole wherein the exposed receptacles each include a cavity that has an opening formed in and parallel to the ground-facing bottom surface of the midsole and which recesses below a general surface of the exposed receptacle, the cavity being adapted to complement and removably hold a corresponding male engageable element on a removeable sole unit;

wherein for each receptacle, the cavity is formed and defined in a zone portion of receptacle material that extends horizontally outwardly from the cavity and separates the cavity from the midsole horizontally surrounding the receptacle, the zone portion having a resiliently compressible material, thereby resiliently conforming to the corresponding male engageable element on insertion of the male engageable element into the cavity so that the receptacle contributes to the lodging of the engageable element to the midsole and to its removability; and wherein the midsole surrounding the zone portion has a material property that provides more cushioning than the material of the zone portion, the zone portion providing a separation of the cavity and surrounding midsole so that the receptacle can removably hold the male engageable element during use independently of the material properties of the midsole.

21. The interchangeable sole system of claim 20 wherein for a given receptacle, midsole material not only surrounds the receptacle horizontally but is also vertically disposed over and adjacent an end to the cavity that is opposite the opening in the ground facing surface, the adjacent midsole having a slit that can receive an end of the male engageable element placed into the cavity.

22. The interchangeable sole system of claim 21 wherein the male engageable element further comprises a horizontally extending portion off a vertical portion, and the slit of the adjacent cavity has a shape complementary to the horizontal portion, thereby helping to secure the engageable element to the adjacent midsole.

23. The interchangeable sole system of claim 22 wherein the male engageable elements have a complementary narrow form.

24. The interchangeable sole system of claim 20 wherein the receptacles have a generally rectangular shape and the cavities are narrow in form.

* * * * *